US005716745A

United States Patent [19]

Minemura et al.

[11] Patent Number: 5,716,745

[45] Date of Patent: Feb. 10, 1998

[54] ELECTROPHOTOGRAPHIC PHOTORECEPTOR

[75] Inventors: Hiroaki Minemura; Kenichi Yasuda; Yohko Kitahara; Eiichi Sakai, all of Hachioji, Japan

[73] Assignee: Konica Corporation, Tokyo, Japan

[21] Appl. No.: 720,857

[22] Filed: Oct. 3, 1996

Related U.S. Application Data

[63] Continuation of Ser. No. 394,504, Feb. 27, 1995, abandoned.

[30] Foreign Application Priority Data

| | | | |
|---|---|---|---|
| Mar. 2, 1994 | [JP] | Japan | 6-032508 |
| Sep. 21, 1994 | [JP] | Japan | 6-226818 |
| Oct. 19, 1994 | [JP] | Japan | 6-253576 |

[51] Int. Cl.[6] ..... G03G 5/14

[52] U.S. Cl. ..... 430/64; 430/60; 430/31

[58] Field of Search ..... 430/60, 64, 65

[56] References Cited

U.S. PATENT DOCUMENTS

| | | | |
|---|---|---|---|
| 4,444,862 | 4/1984 | Yagi et al. | 430/67 |
| 5,188,916 | 2/1993 | Hodumi et al. | 430/65 |
| 5,286,591 | 2/1994 | Hongo | 430/60 |
| 5,372,904 | 12/1994 | Yu et al. | 430/65 X |

FOREIGN PATENT DOCUMENTS

| | | | |
|---|---|---|---|
| 0378153 | 7/1990 | European Pat. Off. . | |
| 0497523 | 8/1992 | European Pat. Off. . | |
| 3228218 | 3/1983 | Germany . | |
| 4221599 | 1/1993 | Germany . | |
| 145251 | 6/1987 | Japan | 430/64 |
| 273547 | 11/1987 | Japan | 430/64 |

*Primary Examiner*—Roland Martin

*Attorney, Agent, or Firm*—Finnegan, Henderson, Farabow, Garrett & Dunner, L.L.P.

[57] ABSTRACT

An electrophotographic photoreceptor is disclosed. The photoreceptor has an interlayer and a photosensitive layer provided on a conductive support, in which the interlayer comprising: an alkoxy metallic chelate compound of titanium or aluminum having a chelate group of acetoacetic ester or β-diketone; and a silane coupling reagent having an organic functional group, the end of which is methacryloxy or amino group. A method of forming an electrophotographic image is also disclosed.

14 Claims, No Drawings

ELECTROPHOTOGRAPHIC PHOTORECEPTOR

This is a continuation of application Ser. No. 08/394,504, filed Feb. 27, 1995, now abandoned.

FIELD OF THE INVENTION

The present invention relates to an electrophotographic photoreceptor. The present invention also relates to an image forming apparatus in which the electrophotographic photoreceptor is used.

BACKGROUND OF THE INVENTION

Recently, there is a demand for a highly functional electrophotographic type image forming apparatus. One of the demands is a copying machine, the processing speed of which is high. In order to assemble a photoreceptor to this machine, the photoreceptor must be highly sensitive and excellent in the stability when it is repeatedly used. In order to provide this excellent photoreceptor performance, it is very important that the performance of carrier generation material (referred to as CGM hereinafter) is high. Therefore, a large number of materials such as azo compound and polycyclic quinone compound have been proposed until now. Recently, attention is given to perylene compounds, especially to imidazole perylene compounds, because they are highly sensitive and very stable when they are used repeatedly.

Further, there is a strong demand for an image forming apparatus recently that can be used as an output device of a computer or as an output device capable of processing various images. Specifically, there is a strong demand for a laser beam printer (referred to as LBP hereinafter) or a digital copying machine. In order to assemble a photoreceptor to these apparatus, it is necessary that the photoreceptor is sufficiently highly sensitive with respect to a beam of light of long wavelength emitted by the semiconductor laser. Therefore, a phthalocyanine compound attracts notice, which is a carrier generation material (CGM) highly sensitive with respect to a beam of light of long wavelength. Various phthalocyanine compounds are proposed. Especially, titanyl phthalocyanine (referred to as TiOPc hereinafter) is a CGM capable of accomplishing high sensitivity and high image quality. TiOPc is sufficiently sensitive in the long wavelength region from 600 nm to 850 nm. (In this specification, the long wavelength region is defined as a region, the wavelength of which is from 600 nm to 850 nm.) Accordingly, TiOPc is very suitable to the photosensitive material used for an image forming apparatus in which an LED, EL (electro-luminescence) or LCD (liquid crystal shutter) is used for the light source.

The improvement of the CGM is not sufficient for the demand of high speed copying machine or LBP and therefore various attempts are required on other items for improving other characteristics. One example is an improvement of an interlayer. It is provided between the conductive support and the photosensitive layer in order to enhance the mechanical adhesion property and restrain the electrical image defect. (An example of the serious image defect is black spots or white spots. In the case of reversal development process which is used in LBP, small black spots sometimes appear on a copied white image surface. In the case of normal development, white spots sometimes appear on a copied solid black image surface.) Examples of usable materials to compose the interlayer are: polyamide resin, polyester resin, and polyurethane resin, which are most commonly used.

When the interlayer made of resin and the carrier generation material (CGM) such as imidazole perylene compound and TiOPc are combined on the photoreceptor, images of high quality, that is, images excellent in contrast and resolution can be provided even if the photoreceptor is assembled to a high speed machine. However, the aforementioned excellent performance can be exhibited only when the apparatus is used in an environment of normal temperature and normal humidity. The excellent performance can be stably provided only in the initial stage of operation. In the environments of high temperature, high humidity, low temperature and low humidity, and in the environment in which a large number of sheets are continuously copied, several problems may be encountered.

For example, the following problems may be encountered. Under the condition of high temperature and high humidity, resistance of the intermediate resin layer is lowered so that the barrier property is deteriorated, and further the electrical carrier generating property of imidazole perylene compound and TiOPc is high. Therefore, positive holes tend to be injected from conductive support, so that image defects such as white spots or black spots tend to occur. Under the condition of low temperature and low humidity, resistance of the resin layer is raised, so that the barrier property is enhanced. Accordingly, sensitivity is lowered, and the residual potential is increased when the photoreceptor is repeatedly used. Especially when TiOPc is used as CGM, the above problems become remarkable since the carrier generating capacity of TiOPc is low under the condition of low temperature and low humidity.

As described above, when imidazole perylene compound or TiOPc was used combined with the intermediate resin layer as described above, it was possible to provide advantages, however, the following disadvantages may be encountered. The CGM having the high carrier generating ability is subjected by the variation of resistivity due to the change of environment to cause white spots or black spots and further the deterioration of electrical potential.

When CGM made of TiOPc is combined with the resin layer, in addition to the above problems, other problems may be encountered. When the photoreceptor of TiOPc is used under a condition of reversal development process which is common in the LBP and digital copying machine, the problem of transfer memory is caused.

In the LBP or digital copying machine, a photoreceptor surface corresponding to the image portion is subjected to exposure of a laser beam, and the formed image is subjected to reversal development. Concerning the transfer charging process, in the case of a negatively charged photoreceptor, charging is carried out so that the photoreceptor can be charged to be a reverse polarity. It can be considered that the negative charge induced by the positive carrier generated on the photoreceptor surface during the transfer process exists on an interface between the carrier generation layer, which is a photosensitive layer, and the interlayer, which is a resin layer. When this negative charge is accumulated without being erased, a sufficiently high charging potential can not be provided on the surface, and fog appears on the image. This phenomenon is referred to as transfer memory. That is, the problem of transfer memory is encountered.

In the case where TiOPc is used as CGM, electrons tend to be injected from the metal support onto the photoreceptor compared with a case in which azo compounds are used. Therefore, a negative carrier induced by the positive charge is difficult to be erased since the resin layer, which is the interlayer, exists. The problem of transfer memory is remarkably caused when CGM composed of TiOPc and the interlayer composed of resin are combined.

Several attempts have been made to solve the above problems by improving the interlayer. For example, an attempt has been made on a method in which organic or inorganic conductive particles are dispersed on the resin layer. However, the above method is not competent for solving the problem of potential characteristics, and further image defects tend to occur, and the above method is disadvantageous in that the dispersion stability of a coating solution is low.

Japanese Patent Publication Open to Public Inspection No. 93062/1983 discloses a technique for providing an interlayer by mixing a resin with metal alkoxide chemical compound and metal chelate compound. However, this method is not competent for improving the potential characteristics, either.

Unlike the above method in which the resin layer or resin containing layer is used, another method has been proposed, in which the interlayer is formed from an organic metal compound and silane coupling reagent without using resin. For example, Japanese Patent Publication Open to Public Inspection No. 272277/1985 discloses a technique in which a metal alkoxide compound and silane coupling reagent are used.

According to Japanese Patent Publication Open to Public Inspection Nos. 73962/1991 and 36758/1992, a zirconium chelate chemical compound and a silane coupling reagent are combined. However, even when the above techniques are adopted, it is impossible to provide a photoreceptor, the characteristics of which are sufficiently high.

In this specification, in order to distinguish the interlayer composed of an organic metal compound and silane coupling reagent of the invention from the interlayer composed of resin, the former is referred to as a ceramic interlayer.

The characteristics of the ceramic interlayers have been investigated and evaluated. And several problems of the interlayers have been found.

For example, as disclosed in Japanese Patent Publication Open to Public Inspection No. 272277/1987, when a metal alkoxide compound is used as the organic metal compound, cracks occur on the formed interlayer, and further a precipitation is generated in the coating solution when a certain period of time has passed after the preparation. Therefore, the characteristics are not competent.

When a zirconium chelate compound is used as disclosed in Japanese Patent Publication Open to Public Inspection Nos. 73962/1991 and 36758/1992, a precipitation is generated in the coating solution when a predetermined period of time has passed after the preparation, so that the stability of the solution is low.

As described above, when the conventional ceramic interlayer is put into practical use, it is very disadvantageous in that the performance of the interlayer is deteriorated, that the pot life is short when a predetermined period of time has passed after the preparation. Further, when CGM is combined with imidazole perylene compound and TiOPc, the aforementioned problems can not be completely solved, that is, image defects and transfer memory caused in the case of reversal development can not be completely suppressed.

The present invention has been achieved to solve the above problems caused in the conventional interlayer and photoreceptor.

The first object of the present invention is to stably provide an electrophotographic photoreceptor including an interlayer characterized in that: the interlayer is formed from a coating solution in which a precipitation is not generated when a predetermined time has passed after the preparation; and even when an electrophotographic photoreceptor, the interlayer of which is formed from the coating solution, is repeatedly used under a wide range of temperature and humidity condition, the interlayer exhibits a sufficiently high charging capacity, residual electrical potential and excellent image forming characteristics.

SUMMARY OF THE INVENTION

That is, an object of the present invention is to provide an electrophotographic photoreceptor, the pot life of the coating composition (a period of time in which the high performance can be exhibited) is sufficiently long, and the electrical potential characteristic and image characteristic of photoreceptor are excellent.

The second object of the present invention is to stably provide an electrophotographic photoreceptor characterized in that: even when the photoreceptor is mounted on an image forming apparatus, the image forming process speed of which is high, and operated over a long period of time, images of high contrast and resolution can be formed, so that the occurrence of image defects such as white spots, fog and deterioration of density can be avoided and the electrical potential is stable.

The third object of the present invention is to stably provide an electrophotographic photoreceptor characterized in that: even when the exposure light source of the image forming apparatus is a semiconductor laser, the wavelength of which is long, images of high contrast and resolution can be formed when the photoreceptor has a sufficiently high photosensitivity, so that the occurrence of image defects such as black spots, fog caused by transfer memory and deterioration of density can be avoided.

The electrophotographic photoreceptor of the invention comprises an interlayer and a photosensitive layer provided on an electrical conductive support in which the interlayer contains: a metallic chelate compound of formula I and a compound of formula II.

$$(RO)_m MX_n \qquad \text{I}$$

$$Z_a A_b SiY_c \qquad \text{II}$$

wherein, R is an alkyl group, preferably having not more than 4 carbon atoms; M is a titanium or Aluminium; X is a chelate forming group such as an acetoacetic ester group or a β diketone group; m and n are individually an integer more than 1 provided that the sum of m and n is 4 in case that M is a titanium and 3 in case that M is an aluminium, preferably m is not less than n;

Z is a hydrolysis group such as an alkoxy group, a halogen atom or an amine group, preferably an alkoxy group having not more than 4 carbon atoms; A is an alkyl or aryl group, preferably having not more than 8 carbon atoms; Y is an organic functional group having methacryloxy or amino group at the end thereof, such as —BOOC(R')C=$CH_2$, —BNHR" or —$BNH_2$, wherein B is an alkylene group or an alkylene group having —O—, —NH—, NR'— or CO— therein, preferably —BOOC(R')C=$CH_2$ and —BNHR", most preferably —BOOC(R')C=$CH_2$; R is an aklkyl group, preferably having not more than 4 carbon atoms; R' is an alkyl or aryl group, preferably an alkyl group having not more 6 carbon atoms and an aryl group having not more than 8 carbon atoms; a and c are individually an integer not less than 1 and b is an integer not less than 0 with proviso the sum of a, b and c is 4, preferably c is 1 and a is not less than 2.

The photosensitive layer of the invention preferably contains imidazole perylene or titanylphthalocyanine pigment. The preferable imidazole perylene pigment is a crystal form having peaks at 6.3°±0.2°, 12.4°±0.2°, 25.3°±0.2° and 27.1°±0.2° in the X-ray diffraction spectrum with respect to Cu-Kα rays, and the peak intensity at 12.4°±0.2° is maximum and the peak width at half height is not less than 0.65° and a clear peak is not shown at 11.5°±0.2°. The preferable titanyl phthalocyanine is a crystal form having peaks at 9.6°±0.2°, 11.7°±0.2°, 15.0°±0.2°, 24.1°±0.2° and 27.3°±0.2° in the X-ray diffraction spectrum with respect to Cu-Kα rays.

BRIEF DISCLOSURE OF THE INVENTION

FIG. 1 is a sectional view of the image forming apparatus of the present invention.

FIG. 2 is a view showing an X ray diffraction spectrum of titanyl phthalocyanine (Synthetic Example 1, thin film sample) according to the present invention.

FIG. 3 is a view showing an X ray diffraction spectrum of imidazole perylene compound (synthetic substance, powder sample) according to the present invention.

FIG. 4 is a view showing an X ray diffraction spectrum of imidazole perylene compound (sublimation substance, powder sample) according to the present invention.

FIG. 5 is a view showing an X ray diffraction spectrum of imidazole perylene compound (AP substance, powder sample) according to the present invention.

FIG. 6 is a view showing an X ray diffraction spectrum of imidazole perylene compound (Example 8, powder sample) according to the present invention.

DETAILED DISCLOSURE OF THE INVENTION

The ceramic based interlayer was known and composing materials, i.e. metal, chelate compound and coupling reagent, were selected widely. However it was hard to have found the sufficient combination of the materials that all of charging potential characteristics, image characteristics and pot life of coating composition are satisfied. Further it is required to restrain the occurrence of image defects used in combination with the high photosensitive materials.

Concerning the organic metal compound to compose the interlayer, it is necessary to select a metal chelate compound having at least one chelate group.

Concerning the metallic chelate compound, typical chelate groups are described as follows.

(1) β-diketone such as acetylacetone and 2,4-heptanedion (2) Ketoester such as acetoacetic methyl, acetoacetic ethyl, acetoacetic propyl and acetoacetic butyl.

(3) Hydroxy carboxylic acid such as lactic acid, salicylic acid and maleic acid (4) Hydroxy carboxylic acid such as lactic acid methyl, lactic acid ethyl, salicylic acid ethyl, and maleic acid ethyl (5) Glycol such as octanediol and hexanediol (6) Ketoalcohol such as 4-hydroxy-4-methyl-2-pentanon (7) Aminoalchol such as triethanolamine.

The present inventors made investigation into the chemical compounds described above. As a result, the following problems were encountered with respect to the items (3) to (7):

The residual electrical potential was high in the initial stage or when the photoreceptor was repeatedly used. The film forming property was low. The adhesion property onto the photosensitive layer was low. Image defects such as white spots and black spots were caused.

According to the results of the investigation, it was found that β-diketone of item (1) and acetoacetic ester of item (2) were excellent in view of the characteristics of electrical potential, film forming property, adhesion property, image characteristic, and pot life of the coating solution. Concerning β-diketone described item (1), acetyl acetone is most preferable since it can be put into general use and its characteristics are excellent.

However, from the viewpoint of the pot life, i.e. the stability of the coating composition, acetoacetic ester described in item (2) is more preferable since it is more stable. When β-diketone chelate compound is used, the following problems may be encountered. When a photoreceptor is formed using an interlayer coating solution prepared several months before, the residual electrical potential becomes higher than that of a photoreceptor formed using a coating solution prepared immediately before.

On the other hand, when acetoacetic ester chelate compound is used, there is no possibility that the residual electrical potential is raised with the lapse of time. Accordingly, high performance can be stably provided.

According to the result of the investigation, it was found that the number of chelate groups of the organic metal compound must be put in an appropriate range. In the case where the organic metal compound has no alkoxy groups but it only has chelate groups, the residual electrical potential is raised. Therefore, it is necessary that the organic metal compound has at least one alkoxy group. It is preferable that the number of chelate groups in the chemical compound is not more than the number of alkoxy groups. Due to the foregoing, the residual electrical potential can be maintained at a low level.

Type of a metal used for the organic metal compound was examined, In case that a known zirconium chelate compound is used, the pot life is short in such a manner that precipitation is caused when a certain period of time has passed after the preparation of the coating solution. Some other metals are not suitable for general use, so that the manufacturing method has not been established yet, or the cost is high. Therefore, they are not put into practical used. A titanium and aluminum are preferably used in the present invention. They give a stable coating composition and do not show the image defects. They also show reduce increase of residual potential when repeatedly used. Especially titanium compound gives reduced residual potential.

Titanium chelate compounds used in the present invention will be described below.

Examples of usable chemical compounds having an acetoacetic ester chelate group are:

diisopropoxytitaniumbis(methylacetoacetate),
diisopropoxytitaniumbis(ethylacetoacetate),
diisopropoxytitaniumbis(propylacetoacetate),
diisopropoxytitaniumbis(buthylacetoacetate),
dibutoxytitaniumbis(methylacetoacetate),
dibutoxytitaniumbis(ethylacetoacetate),
triisoprpoxytitanium(methylacetoacetate),
triisoprpoxytitanium(ethylacetoacetate),
tributoxytitanium(methylacetoacetate),
tributoxytitanium(ethylacetoacetate),
isopropoxytitaniumtri(methylacetoacetate), isopropoxytitaniumtri(ethylacetoacetate), isobutoxytitaniumtri(methylacetoacetate), and isobutoxytitaniumtri(ethylacetoacetate).

Examples of usable chemical compounds having a β-diketone chelate group are:

diisopropoxytitaniumbis(acetylacetone), diisopropoxytitaniumbis(2,4-heptanedionate), dibutoxytitaniumbis(acetylactonate), dibutoxytitaniumbis(2,4-heptanedionate), triisopropoxytitanium(acetylactonate), triisopropoxytitanium(2,4-heptanedionate), tributoxytitanium(acetylacetonate), tributoxytitanium(2,4-heptanedionate), isopropoxytitaniumtri(acetylacetonate), isopropoxytitaniumtri(2,4-heptanedionate), isobutoxytitaniumtri(acetylactonate), and isobutoxytitaniumtri(2,4-heptanedionate).

Aluminum chelate compounds used in the present invention are described below.

Examples of usable chemical compounds having an acetoacetic ester chelate groups are:

diisopropoxyaluminum(methylacetoacetate), diisopropoxyaluminum(ethylacetoacetate), diisopropoxyaluminum(propylacetoacetate), diisopropoxyaluminum(butylacetoacetate), dibutoxyaluminum(methylacetoacetate), dibutoxyaluminum(ethylacetoacetate), isopropoxyaluminumbis(methylacetoacetate), isopropoxyaluminumbis(ethylacetoacetate), isobutoxyaluminumbis(methylacetoacetate), and isobutoxyaluminumbis(ethylacetoacetate).

Examples of usable chemical compounds having a β-diketone chelate group are:

diisopropoxyaluminum(acetylacetonate), diisopropoxyaluminum(2,4-heptanedionate), dibutoxyaluminum(acetylacetonate), dibutoxyaluminum(2,4-heptanedionate), isopropoxyaluminumbis(acetylacetonate), isopropoxyaluminumbis(2,4-heptanedionate), isobutoxyaluminumbis(acetylacetonate), isobutoxyaluminumbis(acetylacetonate), and isobutoxyaluminumbis(2,4-heptanedionate).

The silane coupling reagent, used in the present invention, is represented by the following formula II.

$$Z_aA_bSiY_c \qquad \text{II}$$

Z: hydrolyzable group (an alkoxy group, Halogen atom or an amino group)

A: alkyl group or aryl group

Y: organic functional group a, b, c: a and c are integers not less than 1, and b is an integer not less than 0, and the equation a+b+c=4.

In Japanese Patent Publication Open to Public Inspection No. 4-247461 those are disclosed as examples of Z a methoxy group, ethoxy group, propoxy group and butoxy group; as examples of A methyl, ethyl, propyl, butyl and phenyl group; and as examples of ending group of Y following groups:

$CH_2{=}C(CH_3)COO$—,

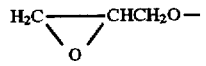

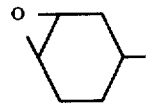

—$NH_2$, $NH_2CH_2CH_2NH$—, HS— and Cl—.

The inventor have found that the functional group Y effects the characteristics of the interlayer remarkably. For example, those having —SH group or Chloride tend to be cracked in the photoreceptor, and those having epoxy group tend to give an image defect. We have found the best functional group is that having methacryroxy group at the end, and next one is that having an amino group at the end.

The methacryroxy group is represented by formula of $CH_2{=}C(R')COO$—, wherein R' is an alkyl group, preferably those having not more than 3 carbon atoms. Examples of silan coupling reagent having the methacryroxy group are;

γ-methylmethacryroxypropyltrimethoxysilane,

γ-methylmethacryroxypropyltriethoxysilane,

γ-ethylmethacryroxypropyltrimethoxysilane,

γ-methylmethacryroxypropylmethyldimethoxysilane, and

γ-methylmethacryroxypropylmethyldiethoxysilane.

By using the silane coupling reagent, it is possible to provide a higher film forming characteristic, image characteristic and electrical potential characteristic. Remarkable characteristics represented by the silane coupling reagent having methacryroxy group at the end is the stability of potential. It provides an interlayer giving very stable property that residual potential rises slightly in case using repeatedly.

The other good silane coupling reagent that is next to those having methacryroxy group, is that having an amino group, i.e. —$NH_2$ or —NHR" at the end of the chemical formula. R" is an alkyl or aryl group, preferably an alkyl group having not more than 6 carbon atoms and an aryl group having not more than 8 carbon atoms.

According to the investigation made by the present inventors, the following were found:

The silane coupling reagent having this amino group at the end has a higher reactivity than the other coupling reagent, and when the interlayer film is formed, the net work constitution tends to be formed by polymerization with metallic chelate compounds. This high reactivity greatly contributes to the suppression of occurrence of image defects such as white spots or black spots. It is assumed that this silane coupling reagent is superior to others from the above viewpoint.

Concerning the reactivity, the reactivity of the first or secondary amino group is high. Especially, the reactivity of the first class amino group of —$NH_2$ is very high, so that it is effective for the suppression of occurrence of image defects.

Examples of specific organic functional groups having —$NH_2$ at the end are: a γ-aminopropyl group, γ-aminoethyl group, and γ-aminobutyl group. Examples of the silane coupling reagents having the above organic functional group are: γ-aminopropyltrimethoxysilane, γ-aminopropyltriethoxysilane, γ-aminopropylmethyldimethoxysilane, γ-aminopropylmethyldiethoxysilane, γ-aminoethyltrimethoxysilane, and γ-aminobutyltrimethoxysilane.

Constitution of the organic functional group is explained more in detail. As described above, the aliphatic hydrocarbon chain $—(CH_2)_k$ is used as the joint component of the organic functional group, and further $—(CH_2)_k—NH—(CH_2)_j—$, $—(CH_2)_k—O—(CH_2)_j—$ and $—(CH_2)_k—NH—CO—$ containing an amino group or carbonyl group may be adopted. Herein k and j are respectively an integer, preferably not more than 10.

Examples of the aforementioned organic functional groups are: an N-β(aminoethyl)y-aminopropyl group, N-β(aminopropyl)γ-aminopropyl group, N-β(aminoethyl)y-aminobutyl group, and γ-ureidopropyl group.

Examples of usable silane coupling reagents having this organic functional group are:

N-β(aminoethyl)γ-aminopropyltrimethoxysilane,

N-β(aminoethyl)γ-aminopropyltriethoxysilane,

N-β(aminoethyl)γ-aminopropylmethyldimethoxysilane,

N-β(aminoethyl)γ-aminopropylmethyldiethoxysilane,

N-β(aminopropyl)γ-aminopropylmethylmethoxysilane,

N-β(aminoethyl)γ-aminobutyltrimethoxysilane,

γ-ureidopropyltrimethoxysilane, and

γ-ureidopropyltriethoxysilane.

When the photoreceptor is assembled to an image forming apparatus, the proces speed of which is high in the process of image formation, and when the photoreceptor is repeatedly used under the above condition, the joint component composed of only aliphatic hydrocarbon chain $—(CH_2)_k—$ is superior in view of increasing the sensitivity and reducing the residual electrical potential, so that an excellent electrical potential performance can be provided.

Examples of R", i.e., aliphatic or aromatic hydrocarbon groups, which are introduced to the secondary amino group, are: an alkyl group such as a methyl group, ethyl group, propyl group and butyl group; a residue of unsaturated aliphatic hydrocarbon such as a vinyl group and allyl group; and an aryl group such as a phenyl group, tolyl group, xylyl group and naphthyl group.

Examples of usable organic functional groups having the secondary amino group at the end are: an N-methyl-γ-aminopropyl group, N-ethyl-γ-aminopropyl group, N-vinyl-γ-aminopropyl group, N-allyl-γ-aminopropyl group, N-phenyl-γ-aminopropyl group, and N-tolyl-γ-aminopropyl group.

Examples of silane coupling reagents having these organic functional groups are:

an N-methyl-γ-aminopropyltrimethoxysilane,

N-ethyl-γ-aminopropyltrimethoxysilane,

N-vinyl-γ-aminopropyltrimethoxysilane,

N-allyl-γ-aminopropyltrimethoxysilane,

N-phenyl-γ-aminopropyltrimethoxysilane, and N-tolyl-γ-aminopropyltrimethoxysilane.

In the present invention, the interlayer contains at least one type of metallic chelate compound of titanium or aluminum and a silane coupling reagent. When necessary, not less than two types may be mixed.

When necessary, resins or other chemical compounds may be contained.

The interlayer selected in the manner described above is improved as compared with a conventional ceramic interlayer. The points of improvements are described as follows:

Pot life of the interlayer coating solution, which is a serious problem when it is put into practical use, can be remarkably enhanced. Therefore, this interlayer is used, an excellent electrical potential characteristic and image characteristic can be provided.

According to the interlayer of the prior art, the electrical potential characteristic, image characteristic and pot life were not sufficiently satisfied at the same time. The reason why the present invention has attained the compatibility of the three factors is the most optimum selection of the material of the ceramic interlayer. Specifically, the material to make the interlayer was selected in the following manner:

The type of the central metal of the organic metal compound, the type and number of the chelate group and the type of the silane coupling reagent were optimized. Therefore, the reactivity of both compounds in the coating solution, the reactivity in the process of thermosetting, the film forming property of the interlayer, the resistance, the work function and the surface energy were maintained to be the most appropriate levels. Especially, the reactivity of both chemical compounds in the coating solution and in the process of thermosetting greatly affected the pot life and image characteristic. From this viewpoint, in order to realize the enhancement of the pot life and image characteristic, a large number of chemical compounds were inappropriate and excluded in the selection.

As described above, an excellent interlayer for accomplishing the first object of the present invention was provided.

As described before, the second object of the present invention is to form an image of high contrast and resolution even when the photoreceptor is mounted on an image forming apparatus, the proces speed of which is high, and repeatedly used over a long period of time. In order to accomplish the above object, it is necessary to provide a CGM, the sensitivity of which is very high, and the performance stability of which is high when it is repeatedly used. As a result of the investigations made by the present inventors, it is concluded that the imidazole-perylene compound is the one of the most preferable CGM in order to attain high sensitivity and resolution.

The structure of imidazole-perylene compound is expressed by either of the following structural formulas.

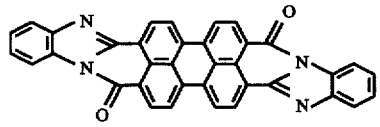

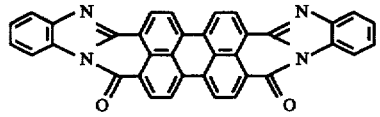

The most preferable imidazole perylene compound is that has a crystal form having peaks at 6.3°±0.2°, 12.4°±0.2°, 25.3°±0.2° and 27.1°±0.2° in the X-ray diffraction spectrum with respect to Cu-Kα rays, and the peak intensity at 12.4°±0.2° is maximum and the peak width at half height is not less than 0.65° and a clear peak is not shown at 11.5°±0.2°.

The carrier generating capacity of CGM depends on not only the molecular structure of CGM but also the stacking form of these molecules (the crystal structure). In the investigation made by the present inventors, they found the following:

Imidazole-perylene compound having the crystal structure of the aforementioned X-ray diffraction spectrum can be provided has a high carrier generation capacity and exhibits an excellent performance.

Concerning the crystal form of imidazole-perylene, there are provided types "a", "γ", "ε" and "ρ". (J. Image Sci., Vol.33 p151–159 (1989)) The preferable crystal structure used for the invention is the "ρ" type, and imidazole-perylene of the "ρ" type is prepared by growing the crystal to have a maximum peak at 12.5° by processing fine particles in an organic solvent. An example of the method of diffusion and making fine particles is described as follows. The imidazole compound refined by means of sublimation was dissolved in sulfuric acid and then poured into water to become anorphous or crystal (acidic-paste-process). Then the crystal compound is obtained by gently diffusing in an organic solvent of high affinity under existing of a polymer binder. According to this way, fine crystals having higher uniformity are grown than by mechanical powdering process, and crystal defects are avoided because the crystals are not subjected with high impact force. As the result, electrophotographic characteristics are not deteriorated.

As described before, the third object of the present invention is to stably provide an electrophotographic photoreceptor characterized in that: even when the exposure light source of the image forming apparatus is a semiconductor laser, the wavelength of which is long, images of high contrast and resolution can be formed when the photoreceptor has a sufficiently high photosensitivity. In order to accomplish the above object, it is necessary that CGM is provided with a sufficient spectral sensitivity even in the long wavelength region so that an electrical charge is faithfully generated in accordance with a minute difference of exposure amount. Due to the foregoing, it is possible to form an image of high contrast and resolution. As a result, it is concluded that TiOPc is most preferable for CGM.

The basic structure of TiOPc is expressed by the following chemical formula.

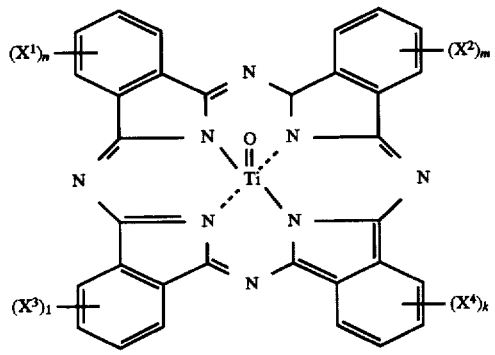

In the chemical formula, $X^1$, $X^2$, $X^3$ and $X^4$ respectively represent a hydrogen atom, halogen atom, alkyl group and alkoxy group. Also in the chemical formula, n, m, l and k respectively represent integers of 0 to 4. The preferable example is that every $X^1$, $X^2$, $X^3$ and $X^4$ is a hydrogen atom.

It is preferable that TiOPc is a crystal form having peaks at 9.5°±0.2°, 9.7°±0.2°, 11.7°±0.2°, 15.0°±0.2°, 23.5°±0.2°, 24.1°±0.2° and 27.3°±0.2° in the X-ray diffraction spectrum with respect to Cu-Kα rays.

Concerning the crystal form of TiOPc, there are provided types A, B and Y. The aforementioned crystal form belongs to the type Y. Compared with other crystal forms, this crystal form has a very high carrier generating capacity. Therefore, this crystal form is most preferable.

The interlayer of the present invention is formed on the conductive support. Concerning the conductive support, a publicly known support such as a metallic support made of aluminum or stainless steel is used, or alternatively a laminated support is used, in which a metallic conductive layer is laminated on an insulating material such as plastic.

The interlayer of the present invention is formed in the following manner:

The organic titanium compound and silane coupling reagent, which are materials to compose the interlayer, are dissolved in a solvent. This solvent (referred to as a coating solution in this specification before) is coated on the conductive support and dried to be hardened. Examples of usable solvents are: alcohol such as methanol, ethanol, propanol and butanol; aromatic hydrocarbon such as toluene; ethyl acetate; and ester such as cellosolve-acetate. The above compounds may be singly used or mixed with each other. When necessary, they may be mixed with water.

Examples of usable coating methods are: a dip coating method, spray coating method, blade coating method, spinner coating method, bead coating method, and curtain coating method.

Preferable drying conditions for drying the coating film are described as follows:

The drying temperature is in a range from 10° to 250° C., and preferably from 90° to 200° C. The drying time is in a range from 5 minutes to 5 hours, and preferably in a range from 20 minutes to 2 hours. Drying may be exerted by air blowing, or alternatively drying may be exerted in a stationary condition. The film thickness of the interlayer is generally 0.1 to 10 μm, and preferably 0.3 to 3 μm.

A photosensitive layer is provided on the interlayer. In this case, the photosensitive layer may be composed of a single layer structure or a laminated layer structure.

In the case of the single layer structure, the photosensitive layer may include the carrier transfer material in which the carrier generation material is diffused.

In the case of the laminated layer structure, the layer may be divided into a carrier generation layer and carrier transfer layer in accordance with the function. When the carrier generation layer and carrier transfer layer are provided on the conductive support, the laminating order may be arbitrarily determined. However, in order to accomplish the objects of the present invention at a higher level, it is preferable to employ the negative charge type in which the carrier transfer layer is provided on the carrier generation layer so as to provide a highly sensitive photoreceptor in which the electrical potential stability is high.

The carrier generation layer is provided in such a manner that the carrier generation material (CGM) is diffused in the binder resin when necessary. Examples of usable CGM are: an inorganic photoconductor such as selenium, selenium alloy, CdS, CdSe, CdSSe, ZnO and ZnS; metal-chelated of nonmetal chelated phthalocyanine compound; bisazo compound; azo compound of triazo compound; squarelium compound; azulenium compound; perylene compound; indigo compound; quinacridone compound; polycyclic quinone compound; cyanin pigment; xanthene dye; and an electrical carrier transfer complex composed of poly-N-vinylcarbazole and trinitrofluorenone. In this case, 2 types of them may be mixed with each other when necessary. It is preferable to use a type of perylene compound, a type of imidazole perylene compound or metallic phthalocyanine compound, and titanyl phthalocyanine (TiOPc). In order to accomplish the second object, imidazole perylene compound is the most preferable, CGM and in order to accomplish the third object, TiOPc is the most preferable, CGM.

Examples of usable binder resins to compose the carrier generation layer are: polystyrene resin, polyethylene resin, polypropylene resin, acrylic resin, methacrylic resin, vinyl chloride resin, vinyl acetate resin, polyvinyl butyral resin, epoxy resin, polyurethane resin, phenol resin, polyester resin, alkyd resin, polycarbonate resin, silicon resin, melamine resin, and copolymer resin containing at least two of the above resins, for example, vinyl chloride-vinyl acetate-maleic anhydride copolymer, and semiconductive polymer, for example, poly-N-vinylcarbazole. In the case where imidazole perylene compound is used as CGM, the preferable binder is polyvinyl butyral resin, and in the case where TiOPc is used as CGM, the preferable binders are silicon resin or polyvinyl butyral resin, or alternatively both resins are mixed with each other.

The carrier transfer layer is singly composed of the carrier transfer material (CTM) or alternatively the carrier transfer layer is composed of the carrier transfer material (CTM) and binder resin. Examples of usable CTM are: a carbazole derivative, oxazole derivative, oxadiazole derivative, thiazole derivative, thiadiazole derivative, triazole derivative, imidazole derivative, imidazolone derivative, imidazolidine derivative, bisimidazolidine derivative, styrile compound, styryl compound, hydrazone compound, pyrazoline derivative, oxazolone derivative, benzimidazole derivative, quinazoline derivative, benzofuran derivative, acridine derivative, phenazine derivative, aminostilbene derivative, triarylamine derivative, phenylenediamine derivative, stilbene derivative, benzidine derivative, poly-N-vinylcarbazole, poly-1-vinylpyrene, and poly-9-vinylanthracene. One of them may be singly used, or not less than two of them may be mixed with each other.

Examples of usable binder resins for composing the carrier transfer layer are: polycarbonate resin, polyacrylate resin, polyester resin, polystyrene resin, styrene-acrylonitrile copolymer resin, polymethacrylic acid ester resin, and styrene-methacrylic acid ester copolymer resin.

In order to reduce the deterioration of the photoreceptor caused by fatigue when it is repeatedly used, or alternatively in order to enhance the durability of the photoreceptor, the publicly known antioxidant, ultraviolet ray absorbing agent, electron receiving material, surface improving agent, plasticizer, and environment dependency reducing agent may be added to each layer of the photoreceptor by an appropriate amount when necessary.

In order to enhance the durability, a non-photosensitive layer such as a protective layer may be provided on the photoreceptor when necessary.

The photoreceptor of the invention is especially effective when adopted in an image forming process using a reverse developing process such as an LBP or digital copying machine. As an example of the image forming apparatus, a digital copying machine using the image forming process is shown in FIG. 1 to illustrate the invention.

In the image reading section 2, a beam of light sent from an illumination light source is incident upon a document, and the reflected beam of light is subjected to color separation, and the document image is formed on CCD. Optical information received by CCD is converted into an electrical signal, and then thus obtained image data is sent to an image writing section 3.

In this case, a photoreceptor drum 1, which is an image forming body, is subjected to corona discharge, so that the photoreceptor drum is uniformly charged. Successively, the photoreceptor drum 1 is exposed to a beam of light sent from a laser beam light source in the image writing section 3. Then the formed latent image is subjected to reversal development, so that a toner image is formed in the exposed portion on the photoreceptor drum 1. In the color image forming apparatus of this example, the image writing operation such as charging and exposing is conducted for each separated color, and also color toner development corresponding to the formed latent image is conducted for each color. The above processes are repeated, and 4 color toner image including yellow, magenta, cyan and black is formed in the photoreceptor.

The 4 color toner image is transferred onto a recording sheet by a transfer pole 6. The recording sheet is separated from the photoreceptor drum by the action of a separation pole 7, and the transferred image on the recording sheet is fixed by a fixing unit 8. On the other hand, the photoreceptor drum is cleaned by a cleaning unit 9.

In the above explanation, formation of 4 color toner image is explained. The embodiment of the present invention is not limited to the specific example, and images of a plurality of colors except for 4 colors may be formed, and further images of a single color may be formed.

Also, the toner image forming method and the transfer method are not limited to the specific examples, and other methods may be adopted.

The present invention is applied to various image forming process other than the above example. Image information may be previously stored in the image memory such as a ROM and floppy disk, and the stored image information may be called when necessary and outputted to the image forming section. Accordingly, the image forming apparatus of the present invention includes an apparatus having no image reading section and the operation is conducted in such a manner that information sent from a computer is stored in the memory and outputted to the image forming section. One of the most typical example is an LED printer or an LBP.

Examples of the metallic chelate compound of the invention are described.

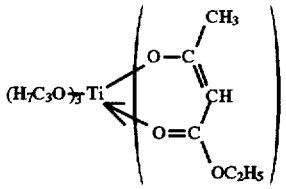

A1

-continued
A2
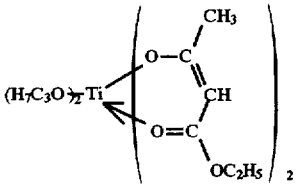
A3
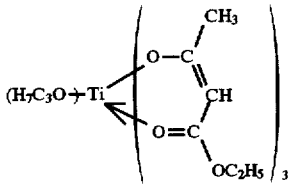
A4
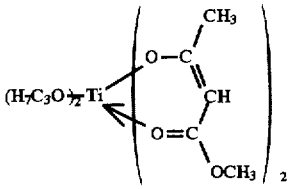
A5
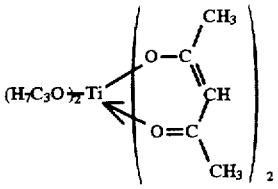
A6
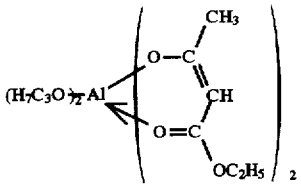
A7
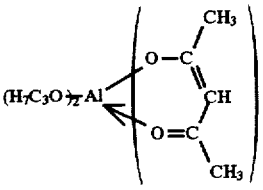
A8
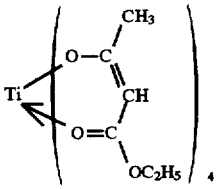
$(H_9C_4O)_4Ti$
A9
A10
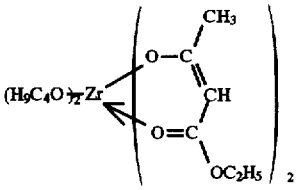

-continued
A11
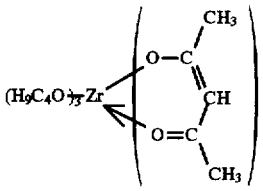
A12
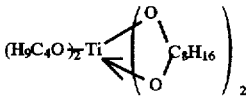
A13
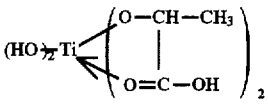
A14
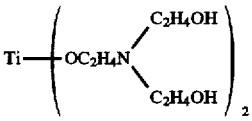
B1
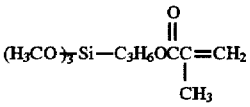
B2
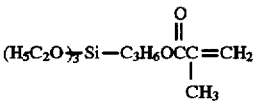
$(H_3CO)_3Si-C_3H_6NH_2$ B3
$(H_5C_2O)_3Si-C_3H_6NH_2$ B4
$(H_3CO)_3Si-C_3H_6NHC_6H_5$ B5
$(H_3CO)_3Si-C_3H_6NHC_2H_4NH_2$ B6
$(H_3CO)_3Si-CH=CH_2$ B7
B8
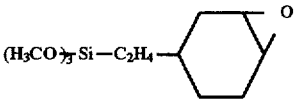
$(H_3CO)_3Si-C_3H_6Cl$ B9
$(H_3CO)_3Si-C_3H_6SH$ B10
C1
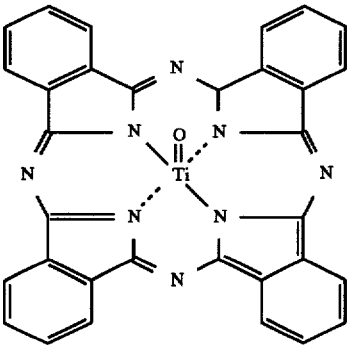

-continued

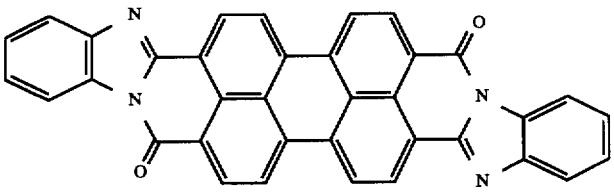

C2(1)

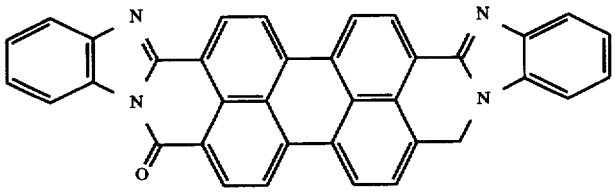

C2(2)

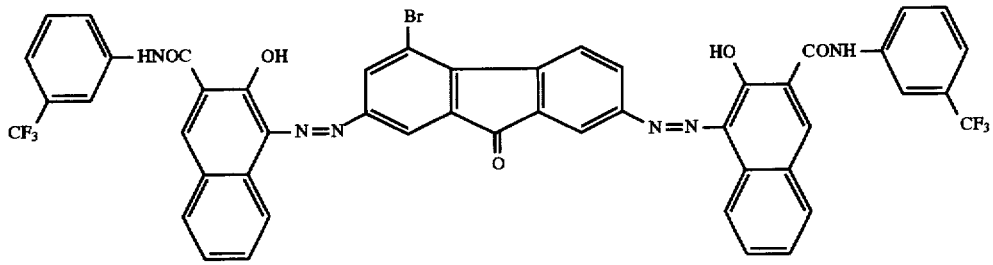

C3

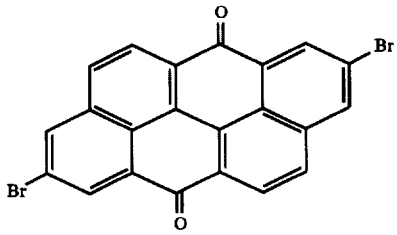

C4

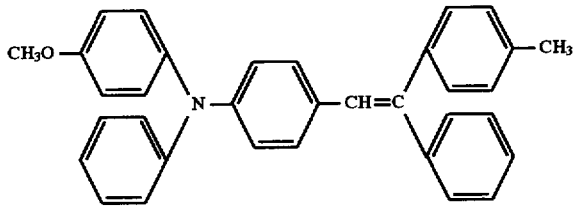

D1

EXAMPLES

An example of the present invention will be explained in detail.

[Synthetic Example]

1,3-diiminoisoindolin 29.2 g

Titaniumtetraisopropoxide 17.0 g

Sulfolane 200 ml

The above chemical compounds were mixed and reacted at 140° C. in the atmosphere of nitrogen for 2 hours.

After the mixture was cooled, the precipitation was filtered out and washed in chloroform. Then the precipitation was washed in a 2% hydrochloric acid aqueous solution and then washed in water and methanol. After that, it was dried, and 25.5 g (88.5%) of titanyl phthalocyanine (C1) was obtained.

This product was dissolved in concentrated sulfuric acid, the amount of which was 20 times as large as that of the product. Then the product dissolved in undiluted sulfuric acid was put into water, the amount of which was 100 times as large, and then precipitated and filtered out. The thus obtained wet cake was heated at 50° C. in dichloroethane for 10 hours. In this way, the crystal form, the X ray diffraction spectrum of which is shown in FIG. 2, was obtained.

Example 1-1

<Interlayer>

Organic metal compound (A1) 140 g

Silane coupling reagent (B1) 60 g

Isopropyl alcohol 2000 ml

Ethyl alcohol 500 ml

The above compounds were mixed and stirred with the stirrer. In this way, the interlayer coating solution was prepared. Three days after the preparation, this coating solution was coated on an aluminum metal support by the dip coating method and dried at 150° C. for 30 minutes. In this way, an interlayer, the thickness of which was 0.7 μm, was formed.

<Carrier Generation Layer>

Carrier generation material (C1) 60 g (titanyl phthalocyanine having the X ray diffraction spectrum shown in FIG. 2 which was obtained in Synthetic Example 1)

Silicon resin solution 700 g (KR5240, 15% xylene butanol solution, manufactured by Shinetsu Kagaku Co.)

Methyl ethyl ketone 2000 ml

The above compounds were mixed and diffused with the sand mill for 10 hours. In this way, the carrier generation layer coating solution was prepared. This coating solution was coated on the aforementioned interlayer by the dip coating method. In this way, the carrier generation layer, the thickness of which was 0.2 μm, was formed.

<Carrier transfer Layer>

Carrier transfer material (D1) 200 g

Bisphenol Z type polycarbonate 300 g (IUPILON Z300, manufactured by Mitsubishi Gas Kagaku Co.) 1,2-dichloroethane 2000 ml The above compounds were mixed and dissolved, so that the carrier transfer layer coating solution was prepared. This coating solution was coated on the above carrier generation layer by the dip coating method. In this way, a carrier transfer layer, the film thickness of which was 20 μm, was formed.

Examples 1-2 to 1-26.

In these examples, the combination of the organic metal compound (A1) in the interlayer coating solution and the silane coupling reagent (B1) was changed as shown in Examples 1-2 to 1-26. Other points were the same as those of Example 1-1. Under this condition, the photoreceptors were made.

Examples 1-27 to 1-28.

EXAMPLES 9 and 12 were modified to prepare EXAMPLES 1-27 and 1-28. The coating compositions of coated after 60 days but not 3 days after preparation The samples are shown with an asterisks in the Table.

Comparative Examples 1-1 to 1-32.

In these examples, the combination of the organic metal compound (A1) in the interlayer coating solution and the silane coupling reagent (B1) was changed as shown in Comparative Examples 1-1 to 1-32. Under this condition, the photoreceptors were made.

Comparative Examples 1-33

In the Example 1-1, only the interlayer was changed as follows. Polyamide resin (CM8000, manufactured by Toray Co.) in an amount of 60 g was dissolved in 2000 ml of methanol. This coating compound was coated on an aluminum metal support by the dip coating method and dried at the room temperature. In this way, an interlayer, the film thickness of which was 0.3 μm, was formed.

Examples 1-1 to 1-28 and Comparative Examples 1-1 to 1-33 are evaluated in accordance with Evaluation 1 described below.

EVALUATION 1

Photoreceptors obtained in Examples 1-1 to 1-21 and Comparative Examples 1-1 to 1-26 were assembled to a copying machine. In this case, the specification of the copying machine was described as follows:

Konica U-BIX4045 copying machine manufactured by Konica Corporation.

The machine was modified to be a digital system in which 780 nm semiconductor laser exposure and reversal development were adopted. Using the above copying machine, 100,000 copies were tested, and the change in the surface electrical potential and the image characteristics were evaluated.

In the test, the following surface electrical potentials were measured.

Electrical potential of a not-exposed portion VH: surface potential of a portion not exposed to laser beams.

Electrical potential of an exposed portion VH: surface potential of a portion exposed to laser beams.

The image characteristics were evaluated with respect to the following image defects.

Black spots: degree of generation of black spots on a white copied image.

Deterioration of density of a solid black area: degree of deterioration of density of a copied black sheet.

Overall fog: degree of generation of fog when a white document, the reflective density of which is 0, is copied Belt-shaped fog by transfer memory: degree of generation of belt-shaped fog on a white copied image caused by transfer memory.

Results of the evaluation are expressed by the following marks.

A . . . Image defects are not caused.

B . . . Image defects are a little caused.

C . . . Image defects are clearly caused.

Results of the evaluation are shown on Tables 1 to 4. In some comparative examples, problems were caused in the process of forming an interlayer. Therefore, it was impossible to evaluate the comparative examples. These comparative examples are shown in the following tables, and the causes of the problems are also shown on the tables.

[Synthetic Example 2]

Perylene-3,4,9,10-tetracarboxylic acid anhydride 39.2 g o-phenylenediamine 32.4 g α-chloronaphthalene 800 ml The above compounds were mixed and reacted at 260° C. for 6 hours.

After cooling, the precipitation was filtered out and repeatedly washed in methanol. After it was heated and dried, 51.5 g of imidazoleperylene compound was obtained as the mixture of (1) and (2) of the structural formula C2. The obtained sample, in the crystal form, was called as a synthesized sample and the X ray diffraction spectrum of which is shown in FIG. 3.

SUBLIMATION EXAMPLE

The imidazoleperylene compound obtained in Synthetic Example 2 was refined by means of sublimation at 500° C. under the pressure of $5\times10^{-4}$ to $5\times10^{-3}$ torr, and volatile impurities were removed by a shutter. Thus obtained refined crystals were subjected again to the same sublimation treatment so that the crystals were further refined. Thus obtained crystals subjected to sublimation treatment twice are referred to as a sublimation sample, and its X ray diffraction spectrum is shown in FIG. 4.

ACID PASTE TREATMENT EXAMPLE

In this example, 20 g of the sublimation substance of imidazoleperylene compound was dissolved in 600 ml of undiluted sulfuric acid. The thus obtained solution was filtered by the glass filter and then dripped into 1200 ml of pure water for precipitation. The precipitation was filtered out and sufficiently washed in pure water and then dried. The thus obtained precipitation is referred to as AP substance (acid paste treatment substance), and its X ray diffraction spectrum is shown in FIG. 5.

Example 2-1

INTERLAYER

An interlayer was formed in the same manner as that of Example 1-2.

CARRIER GENERATION LAYER

Carrier Generating Material (C2) 70 g (Imidazoleperylene compound of AP substance obtained in the acid paste treatment example)

Polyvinylbutyral resin 15 g (Eslec BL-S manufactured by Sekisui Kagaku Co.)

Methylethylketone 2500 ml

The above compounds were mixed and diffused by the sand mill for 15 hours. In this way, the carrier generation layer coating solution was prepared. The X ray diffraction spectrum of this coating solution is shown in FIG. 6. This coating solution was coated on the aforementioned interlayer by the dip coating method, and a carrier generation layer, the thickness of which was 0.3 μm, was formed.

CARRIER TRANSFER LAYER

A carrier transfer layer was formed on the carrier generation layer described before in the same manner as that of Example 1-2.

Example 2-2

In this example, the interlayer was modified by using A2 and B5 in place of A2 and B1. Except for that, the photoreceptor was formed in the same manner as that of Example 2-1.

EXAMPLE 2-3 and 2-4

In this example, the carrier generating layer was changed in the following away.

Carrier generation material C3 in an amount of 60 g, 15 g of polybutyral resin (Eslec BM-S, a product of Sekisui Chemical) and 2000 ml of Methyl ethyl ketone were mixed and diffused with the sand mill for 10 hours. In this way, the carrier generation layer coating solution was prepared. This coating solution was coated on the aforementioned interlayer by the dip coating method. In this way, the carrier generation layer, the thickness of which was 0.5 μm, was formed. Except for that, the photoreceptor was formed in the same manner as that of Example 2-1 and 2-2.

Example 2-5 and 2-6

In this example, the carrier generating layer was changed in the following away.

Carrier generation material C4 in an amount of 100 g, 50 g of polybutyral resin (Eslec BM-S, a product of Sekisui Chemical) and 2000 ml of Methyl ethyl ketone were mixed and diffused with the sand mill for 10 hours. In this way, the carrier generation layer coating solution was prepared. This coating solution was coated on the aforementioned interlayer by the dip coating method. In this way, the carrier generation layer, the thickness of which was 0.8 μm, was formed. Except for that, the photoreceptor was formed in the same manner as that of Example 2-1 and 2-2.

COMPARATIVE EXAMPLE 2-1, 2-2 and 2-3.

For these examples, the composition of the interlayer of each Examples 2-1, 2-2 and 2-3 was replaced by a combination of A2 and B8, that is fallen without of the invention. Except for that, the photoreceptor was formed in the same manner as that of the Examples.

Examples 2-1 to 2-9 and Comparative Examples 2-1 to 2-3 are evaluated in accordance with Evaluation 2 described below.

EVALUATION 2

Photoreceptors obtained in Examples 2-1 to 2-6 and Comparative Examples 2-1 to 2-3 were assembled to a copying machine manufactured by Konica Corporation, the brand name of which is Konica U-BIX4045 copying machine. Using the above copying machine, 100,000 copies were tested, and the change in the surface electrical potential and the image characteristics were evaluated.

The sensitivity depends upon the species of CGM. So the exposing amount was adjusted so that initial $V_L$ did not excess volts in the reference samples (Examples 2-1, 2-2, 2-5) for fair comparison with each interlayer.

The following surface potentials were measured.

Black sheet electrical potential Vb:

Surface potential with respect to a document, the reflective density of which is 1.3

Residual electrical potential Vr:

Surface potential after the discharge conducted by the optical method

The image characteristics were evaluated with respect to the following image defects.

Non-uniformity of solid area:

Degree of non-uniformity with respect to solid area when minute white spots are generated on the black sheet copied image Overall fog:

Degree of generation of fog when a white document, the reflective density of which is 0, is copied.

Deterioration of density of solid black:

Degree of deterioration of density of a black sheet copied image

The reference of evaluation of image defects is the same as that of Evaluation 1.

Results are shown on Tables 1 to 5.

TABLE 1

| No. of inventive or comparative example | Intermediate layer composition | CGM | Quality evaluation (10° C., relative humidity 20%) | | | | | | | | | | | |
|---|---|---|---|---|---|---|---|---|---|---|---|---|---|---|
| | | | Electrical potential characteristic | | | | Image characteristic | | | | | | | |
| | | | $V_H$ (V) | | $V_L$ (V) | | Black spots | | Density deterioration of solid black area | | Occurrence of fog on the overall surface | | Occurrence of belt-shaped fog after transfer | |
| | | | Initial stage | After 10,0000 prints | Initial stage | After 10,0000 prints | Initial stage | After 10,0000 prints | Initial stage | After 10,0000 prints | Initial stage | After 10,0000 prints | Initial stage | After 10,0000 prints |
| Inventive example 1-1 | A1 B1 | C-1 | 700 | 695 | 30 | 35 | A | A | A | A | A | A | A | A |
| Inventive example 1-2 | A2 B1 | C-1 | 700 | 695 | 30 | 35 | A | A | A | A | A | A | A | A |
| Inventive example 1-3 | A3 B1 | C-1 | 700 | 695 | 35 | 50 | A | A | A | A | A | A | A | A |
| Inventive example 1-4 | A4 B2 | C-1 | 700 | 695 | 30 | 35 | A | A | A | A | A | A | A | A |
| Inventive example 1-5 | A5 B1 | C-1 | 700 | 695 | 30 | 35 | A | A | A | A | A | A | A | A |
| Inventive example 1-6 | A6 B1 | C-1 | 700 | 695 | 35 | 45 | A | A | A | A | A | A | A | A |
| Inventive example 1-7 | A7 B1 | C-1 | 700 | 695 | 35 | 45 | A | A | A | A | A | A | A | A |
| Inventive example 1-8 | A1 B3 | C-1 | 700 | 695 | 30 | 40 | A | A | A | A | A | A | A | A |
| Inventive example 1-9 | A2 B3 | C-1 | 700 | 695 | 30 | 45 | A | A | A | A | A | A | A | A |
| Inventive example 1-10 | A3 B3 | C-1 | 700 | 695 | 35 | 60 | A | A | A | A | A | A | A | A |
| Inventive example 1-11 | A4 B4 | C-1 | 700 | 695 | 30 | 45 | A | A | A | A | A | A | A | A |
| Inventive example 1-12 | A5 B3 | C-1 | 700 | 695 | 30 | 45 | A | A | A | A | A | A | A | A |
| Inventive example 1-13 | A6 B3 | C-1 | 700 | 695 | 35 | 50 | A | A | A | A | A | A | A | A |
| Inventive example 1-14 | A7 B3 | C-1 | 700 | 695 | 35 | 50 | A | A | A | A | A | A | A | A |
| Inventive example 1-15 | A1 B5 | C-1 | 700 | 690 | 30 | 40 | A | A | A | A | A | A | A | A |
| Inventive example 1-16 | A2 B5 | C-1 | 700 | 695 | 30 | 40 | A | A | A | A | A | A | A | A |
| Inventive example 1-17 | A3 B5 | C-1 | 700 | 695 | 35 | 55 | A | A | A | A | A | A | A | A |
| Inventive example 1-18 | A5 B5 | C-1 | 700 | 695 | 30 | 40 | A | A | A | A | A | A | A | A |
| Inventive example 1-19 | A6 B5 | C-1 | 700 | 695 | 35 | 50 | A | A | A | A | A | A | A | A |
| Inventive example 1-20 | A7 B5 | C-1 | 700 | 695 | 35 | 50 | A | A | A | A | A | A | A | A |
| Inventive example 1-21 | A1 B6 | C-1 | 700 | 695 | 40 | 60 | A | A | A | A | A | A | A | A |
| Inventive example 1-22 | A2 B6 | C-1 | 700 | 695 | 40 | 65 | A | A | A | A | A | A | A | A |
| Inventive example 1-23 | A3 B6 | C-1 | 700 | 695 | 45 | 75 | A | A | A | A | A | A | A | A |
| Inventive example 1-24 | A5 B6 | C-1 | 700 | 695 | 40 | 60 | A | A | A | A | A | A | A | A |
| Inventive example 1-25 | A6 B6 | C-1 | 700 | 695 | 45 | 70 | A | A | A | A | A | A | A | A |
| Inventive example 1-26 | A7 B6 | C-1 | 700 | 695 | 45 | 70 | A | A | A | A | A | A | A | A |
| Inventive example 1-27 | A2 B3* | C-1 | 700 | 695 | 30 | 45 | A | A | A | A | A | A | A | A |
| Inventive example 1-28 | A5 B3* | C-1 | 700 | 695 | 40 | 60 | A | A | A | A | A | A | A | A |

TABLE 2

| No. of inventive or comparative example | Intermediate layer composition | CGM | Quality evaluation (10° C., relative humidity 20%) | | | | | | | | | | | |
|---|---|---|---|---|---|---|---|---|---|---|---|---|---|---|
| | | | Electrical potential characteristic | | | | Image characteristic | | | | | | | |
| | | | $V_H$ (V) | | $V_L$ (V) | | Black spots | | Density deterioration of solid black area | | Occurrence of fog on the overall surface | | Occurrence of belt-shaped fog after transfer | |
| | | | Initial stage | After 10,0000 prints | Initial stage | After 10,0000 prints | Initial stage | After 10,0000 prints | Initial stage | After 10,0000 prints | Initial stage | After 10,0000 prints | Initial stage | After 10,0000 prints |
| Comparative example 1-1 | A8 B1 | C-1 | 690 | 660 | 50 | 95 | A | A | A | B | A | A | A | B |
| Comparative example 1-2 | A9 B1 | C-1 | 700 | 680 | 30 | 35 | C | C | A | A | A | A | A | A |
| Comparative example 1-3 | A10 B1 | C-1 | No evaluation (Uniform coating film was not formed due to the precipitation in the coating solution.) | | | | | | | | | | | |
| Comparative example 1-4 | A11 B1 | C-1 | No evaluation (Uniform coating film was not formed due to the precipitation in the coating solution.) | | | | | | | | | | | |
| Comparative example 1-5 | A12 B1 | C-1 | 690 | 655 | 60 | 100 | C | C | A | B | A | A | A | B |
| Comparative example 1-6 | A13 B1 | C-1 | No evaluation (Uniform coating film was not formed due to the precipitation in the coating solution.) | | | | | | | | | | | |
| Comparative example 1-7 | A14 B1 | C-1 | 690 | 655 | 60 | 110 | C | C | A | B | A | A | A | B |
| Comparative example 1-8 | A8 B3 | C-1 | 690 | 660 | 50 | 95 | A | A | A | B | A | A | A | B |
| Comparative example 1-9 | A9 B3 | C-1 | 700 | 650 | 30 | 40 | C | C | A | A | A | A | A | A |
| Comparative example 1-10 | A10 B3 | C-1 | No evaluation (Uniform coating film was not formed due to the precipitation in the coating solution.) | | | | | | | | | | | |
| Comparative example 1-11 | A11 B3 | C-1 | No evaluation (Uniform coating film was not formed due to the precipitation in the coating solution.) | | | | | | | | | | | |
| Comparative example 1-12 | A12 B3 | C-1 | 690 | 660 | 60 | 120 | C | C | A | B | A | A | A | B |
| Comparative example 1-13 | A13 B3 | C-1 | No evaluation (Uniform coating film was not formed due to the precipitation in the coating solution.) | | | | | | | | | | | |
| Comparative example 1-14 | A14 B3 | C-1 | 690 | 660 | 60 | 130 | C | C | A | B | A | A | A | B |
| Comparative example 1-15 | A8 B5 | C-1 | 690 | 660 | 50 | 95 | A | A | A | B | A | A | A | B |
| Comparative example 1-16 | A9 B5 | C-1 | 690 | 650 | 30 | 40 | C | C | A | A | A | A | A | B |
| Comparative example 1-17 | A10 B5 | C-1 | No evaluation (Uniform coating film was not formed due to the precipitation in the coating solution.) | | | | | | | | | | | |
| Comparative example 1-18 | A11 B5 | C-1 | No evaluation (Uniform coating film was not formed due to the precipitation in the coating solution.) | | | | | | | | | | | |
| Comparative example 1-19 | A12 B5 | C-1 | 690 | 660 | 60 | 110 | C | C | A | B | A | A | A | B |
| Comparative example 1-20 | A13 B5 | C-1 | No evaluation (Uniform coating film was not formed due to the precipitation in the coating solution.) | | | | | | | | | | | |
| Comparative example 1-21 | A14 B5 | C-1 | 690 | 660 | 60 | 115 | C | C | A | B | A | A | A | B |
| Comparative example 1-22 | A8 B6 | C-1 | 690 | 660 | 60 | 110 | A | A | A | B | A | A | A | B |
| Comparative example 1-23 | A9 B6 | C-1 | 690 | 650 | 40 | 65 | C | C | A | A | A | A | A | B |
| Comparative example 1-24 | A10 B6 | C-1 | No evaluation (Uniform coating film was not formed due to the precipitation in the coating solution.) | | | | | | | | | | | |
| Comparative example 1-25 | A11 B6 | C-1 | No evaluation (Uniform coating film was not formed due to the precipitation in the coating solution.) | | | | | | | | | | | |
| Comparative example 1-26 | A12 B6 | C-1 | 690 | 660 | 60 | 140 | C | C | A | C | A | A | A | B |
| Comparative example 1-27 | A13 B6 | C-1 | No evaluation (Uniform coating film was not formed due to the precipitation in the coating solution. | | | | | | | | | | | |
| Comparative example 1-28 | A14 B6 | C-1 | 690 | 660 | 70 | 150 | C | C | A | C | A | A | A | B |
| Comparative example 1-29 | A2 B7 | C-1 | 600 | 500 | 40 | 50 | C | C | A | A | C | C | — | — |
| Comparative example 1-30 | A2 B8 | C-1 | 690 | 660 | 55 | 100 | C | C | A | B | A | A | A | B |
| Comparative example 1-31 | A2 B9 | C-1 | No evaluation (Cracking was found in the intermediate layer) | | | | | | | | | | | |

TABLE 2-continued

| No. of inventive or comparative example | Intermediate layer composition | CGM | Quality evaluation (10° C., relative humidity 20%) | | | | | | | | | | | |
|---|---|---|---|---|---|---|---|---|---|---|---|---|---|---|
| | | | Electrical potential characteristic | | | | Image characteristic | | | | | | | |
| | | | $V_H$ (V) | | $V_L$ (V) | | Black spots | | Density deterioration of solid black area | | Occurrence of fog on the overall surface | | Occurrence of belt-shaped fog after transfer | |
| | | | Initial stage | After 10,0000 prints | Initial stage | After 10,0000 prints | Initial stage | After 10,0000 prints | Initial stage | After 10,0000 prints | Initial stage | After 10,0000 prints | Initial stage | After 10,0000 prints |
| Comparative example 1-32 | A2 B10 | C-1 | No evaluation (Cracking was found in the intermediate layer) | | | | | | | | | | | |
| Comparative example 1-33 | Polyamide resin | C-1 | 700 | 660 | 70 | 300 | B | C | A | C | A | A | A | B |

TABLE 3

| No. of inventive or comparative example | Intermediate layer composition | CGM | Quality evaluation (33° C., relative humidity 80%) | | | | | | | | | | | |
|---|---|---|---|---|---|---|---|---|---|---|---|---|---|---|
| | | | Electrical potential characteristic | | | | Image characteristic | | | | | | | |
| | | | $V_H$ (V) | | $V_L$ (V) | | Black spots | | Density deterioration of solid black area | | Occurrence of fog on the overall surface | | Occurrence of belt-shaped fog after transfer | |
| | | | Initial stage | After 10,0000 prints | Initial stage | After 10,0000 prints | Initial stage | After 10,0000 prints | Initial stage | After 10,0000 prints | Initial stage | After 10,0000 prints | Initial stage | After 10,0000 prints |
| Inventive example 1-1 | A1 B1 | C-1 | 700 | 695 | 20 | 25 | A | A | A | A | A | A | A | A |
| Inventive example 1-2 | A2 B1 | C-1 | 700 | 695 | 20 | 25 | A | A | A | A | A | A | A | A |
| Inventive example 1-3 | A3 B1 | C-1 | 700 | 695 | 25 | 35 | A | A | A | A | A | A | A | A |
| Inventive example 1-4 | A4 B2 | C-1 | 700 | 695 | 20 | 25 | A | A | A | A | A | A | A | A |
| Inventive example 1-5 | A5 B1 | C-1 | 700 | 695 | 20 | 25 | A | A | A | A | A | A | A | A |
| Inventive example 1-6 | A6 B1 | C-1 | 700 | 695 | 25 | 35 | A | A | A | A | A | A | A | A |
| Inventive example 1-7 | A7 B1 | C-1 | 700 | 695 | 25 | 35 | A | A | A | A | A | A | A | A |
| Inventive example 1-8 | A1 B3 | C-1 | 700 | 695 | 25 | 40 | A | A | A | A | A | A | A | A |
| Inventive example 1-9 | A2 B3 | C-1 | 700 | 695 | 25 | 45 | A | A | A | A | A | A | A | A |
| Inventive example 1-10 | A3 B3 | C-1 | 700 | 695 | 30 | 60 | A | A | A | A | A | A | A | A |
| Inventive example 1-11 | A4 B4 | C-1 | 700 | 695 | 25 | 45 | A | A | A | A | A | A | A | A |
| Inventive example 1-12 | A5 B3 | C-1 | 700 | 695 | 25 | 45 | A | A | A | A | A | A | A | A |
| Inventive example 1-13 | A6 B3 | C-1 | 700 | 695 | 30 | 50 | A | A | A | A | A | A | A | A |
| Inventive example 1-14 | A7 B3 | C-1 | 700 | 695 | 30 | 50 | A | A | A | A | A | A | A | A |
| Inventive example 1-15 | A1 B5 | C-1 | 700 | 695 | 20 | 30 | A | A | A | A | A | A | A | A |
| Inventive example 1-16 | A2 B5 | C-1 | 700 | 695 | 20 | 30 | A | A | A | A | A | A | A | A |
| Inventive example 1-17 | A3 B5 | C-1 | 700 | 695 | 25 | 40 | A | A | A | A | A | A | A | A |
| Inventive example 1-18 | A5 B5 | C-1 | 700 | 695 | 20 | 30 | A | A | A | A | A | A | A | A |
| Inventive example 1-19 | A6 B5 | C-1 | 700 | 695 | 25 | 40 | A | A | A | A | A | A | A | A |
| Inventive example 1-20 | A7 B5 | C-1 | 700 | 695 | 25 | 40 | A | A | A | A | A | A | A | A |
| Inventive | A1 B6 | C-1 | 700 | 695 | 35 | 65 | A | A | A | A | A | A | A | A |

TABLE 3-continued

| No. of inventive or comparative example | Intermediate layer composition | CGM | Quality evaluation (33° C., relative humidity 80%) | | | | | | | | | | | |
|---|---|---|---|---|---|---|---|---|---|---|---|---|---|---|
| | | | Electrical potential characteristic | | | | Image characteristic | | | | | | | |
| | | | $V_H$ (V) | | $V_L$ (V) | | Black spots | | Density deterioration of solid black area | | Occurrence of fog on the overall surface | | Occurrence of belt-shaped fog after transfer | |
| | | | Initial stage | After 10,0000 prints | Initial stage | After 10,0000 prints | Initial stage | After 10,0000 prints | Initial stage | After 10,0000 prints | Initial stage | After 10,0000 prints | Initial stage | After 10,0000 prints |
| example 1-21 Inventive | A2 B6 | C-1 | 700 | 695 | 35 | 70 | A | A | A | A | A | A | A | A |
| example 1-22 Inventive | A3 B6 | C-1 | 700 | 695 | 40 | 80 | A | A | A | A | A | A | A | A |
| example 1-23 Inventive | A5 B6 | C-1 | 700 | 695 | 35 | 65 | A | A | A | A | A | A | A | A |
| example 1-24 Inventive | A6 B6 | C-1 | 700 | 695 | 40 | 75 | A | A | A | A | A | A | A | A |
| example 1-25 Inventive | A7 B6 | C-1 | 700 | 695 | 40 | 75 | A | A | A | A | A | A | A | A |
| example 1-26 Inventive | A2 B3* | C1 | 700 | 695 | 25 | 45 | A | A | A | A | A | A | A | A |
| example 1-27 Inventive | A5 B3* | C-1 | 700 | 695 | 35 | 65 | A | A | A | A | A | A | A | A |
| example 1-28 | | | | | | | | | | | | | | |

TABLE 4

| No. of inventive or comparative example | Intermediate layer composition | CGM | Quality evaluation (33° C., relative humidity 80%) | | | | | | | | | | | |
|---|---|---|---|---|---|---|---|---|---|---|---|---|---|---|
| | | | Electrical potential characteristic | | | | Image characteristic | | | | | | | |
| | | | $V_H$ (V) | | $V_L$ (V) | | Black spots | | Density deterioration of solid black area | | Occurrence of fog on the overall surface | | Occurrence of belt-shaped fog after transfer | |
| | | | Initial stage | After 10,0000 prints | Initial stage | After 10,0000 prints | Initial stage | After 10,0000 prints | Initial stage | After 10,0000 prints | Initial stage | After 10,0000 prints | Initial stage | After 10,0000 prints |
| Comparative example 1-1 | A8 B1 | C-1 | 690 | 660 | 45 | 140 | A | A | A | C | A | A | A | B |
| Comparative example 1-2 | A9 B1 | C-1 | 700 | 680 | 20 | 25 | C | C | A | A | A | A | A | A |
| Comparative example 1-3 | A10 B1 | C-1 | No evaluation (Uniform coating film was not formed due to the precipitation in the coating solution.) | | | | | | | | | | | |
| Comparative example 1-4 | A11 B1 | C-1 | No evaluation (Uniform coating film was not formed due to the precipitation in the coating solution.) | | | | | | | | | | | |
| Comparative example 1-5 | A12 B1 | C-1 | 690 | 660 | 50 | 150 | C | C | A | C | A | A | A | B |
| Comparative example 1-6 | A13 B1 | C-1 | (No evaluation) (Uniform coating film was not formed due to the precipitation in the coating solution.) | | | | | | | | | | | |
| Comparative example 1-7 | A14 B1 | C-1 | 690 | 660 | 50 | 140 | C | C | A | C | A | A | A | B |
| Comparative example 1-8 | A8 B3 | C-1 | 690 | 660 | 45 | 140 | A | A | A | C | A | A | A | B |
| Comparative example 1-9 | A9 B3 | C-1 | 690 | 650 | 20 | 35 | C | C | A | A | A | A | A | B |
| Comparative example 1-10 | A10 B3 | C-1 | No evaluation (Uniform coating film was not formed due to the precipitation in the coating solution.) | | | | | | | | | | | |
| Comparative example 1-11 | A11 B3 | C-1 | No evaluation (Uniform coating film was not formed due to the precipitation in the coating solution.) | | | | | | | | | | | |
| Comparative example 1-12 | A12 B3 | C-1 | 690 | 660 | 50 | 160 | C | C | A | C | A | A | A | B |
| Comparative example 1-13 | A13 B3 | C-1 | No evaluation (Uniform coating film was not formed due to the precipitation in the coating solution.) | | | | | | | | | | | |
| Comparative example 1-14 | A14 B3 | C-1 | 690 | 660 | 50 | 155 | C | C | A | C | A | A | A | B |
| Comparative example 1-15 | A8 B5 | C-1 | 690 | 660 | 45 | 140 | A | A | A | C | A | A | A | B |

TABLE 4-continued

| No. of inventive or comparative example | Intermediate layer composition | CGM | Quality evaluation (33° C., relative humidity 80%) | | | | | | | | | | | |
|---|---|---|---|---|---|---|---|---|---|---|---|---|---|---|
| | | | | | | | Image characteristic | | | | | | | |
| | | | Electrical potential characteristic | | | | Black spots | | Density deterioration of solid black area | | Occurrence of fog on the overall surface | | Occurrence of belt-shaped fog after transfer | |
| | | | $V_H$ (V) | | $V_L$ (V) | | | | | | | | | |
| | | | Initial stage | After 10,0000 prints | Initial stage | After 10,0000 prints | Initial stage | After 10,0000 prints | Initial stage | After 10,0000 prints | Initial stage | After 10,0000 prints | Initial stage | After 10,0000 prints |
| Comparative example 1-16 | A9 B5 | C-1 | 690 | 650 | 20 | 30 | C | C | A | A | A | A | A | B |
| Comparative example 1-17 | A10 B5 | C-1 | No evaluation (Uniform coating film was not formed due to the precipitation in the coating solution.) | | | | | | | | | | | |
| Comparative example 1-18 | A11 B5 | C-1 | No evaluation (Uniform coating film was not formed due to the precipitation in the coating solution.) | | | | | | | | | | | |
| Comparative example 1-19 | A12 B5 | C-1 | 690 | 660 | 50 | 155 | C | C | A | C | A | A | A | B |
| Comparative example 1-20 | A13 B5 | C-1 | No evaluation (Uniform coating film was not formed due to the precipitation in the coating solution.) | | | | | | | | | | | |
| Comparative example 1-21 | A14 B5 | C-1 | 690 | 660 | 50 | 150 | C | C | A | C | A | A | A | B |
| Comparative example 1-22 | A8 B6 | C-1 | 690 | 660 | 55 | 160 | A | A | A | C | A | A | A | B |
| Comparative example 1-23 | A9 B6 | C-1 | 690 | 650 | 30 | 55 | C | C | A | A | A | A | A | B |
| Comparative example 1-24 | A10 B6 | C-1 | No evaluation (Uniform coating film was not formed due to the precipitation in the coating solution.) | | | | | | | | | | | |
| Comparative example 1-25 | A11 B6 | C-1 | No evaluation (Uniform coating film was not formed due to the precipitation in the coating solution.) | | | | | | | | | | | |
| Comparative example 1-26 | A12 B6 | C-1 | 690 | 660 | 60 | 180 | C | C | A | C | A | A | A | B |
| Comparative example 1-27 | A13 B6 | C-1 | No evaluation (Uniform coating film was not formed due to the precipitation in the coating solution.) | | | | | | | | | | | |
| Comparative example 1-28 | A14 B6 | C-1 | 690 | 660 | 60 | 175 | C | C | A | C | A | A | A | B |
| Comparative example 1-29 | A2 B7 | C-1 | 600 | 500 | 35 | 45 | C | C | A | A | C | C | — | — |
| Comparative example 1-30 | A2 B8 | C-1 | 690 | 660 | 50 | 140 | C | C | A | C | A | A | A | B |
| Comparative example 1-31 | A2 B9 | C-1 | No evaluation (Cracking was found in the intermediate layer) | | | | | | | | | | | |
| Comparative example 1-32 | A2 B10 | C-1 | No evaluation (Cracking was found in the intermediate layer) | | | | | | | | | | | |
| Comparative example 1-33 | Polyamide resin | C-1 | 700 | 660 | 30 | 250 | C | C | A | C | A | A | A | B |

TABLE 5

| No. of inventive or comparative example | Intermediate layer composition | CGM | Quality evaluation (10° C., relative humidity 20%) | | | | | | | | | |
|---|---|---|---|---|---|---|---|---|---|---|---|---|
| | | | | | | | Image characteristic | | | | | |
| | | | Electrical potential characteristic | | | | Solid black uniformity | | Density deterioration of solid black area | | Occurrence of fog on the overall surface | |
| | | | $V_H$ (V) | | $V_L$ (V) | | | | | | | |
| | | | Initial stage | After 10,0000 prints | Initial stage | After 10,0000 prints | Initial stage | After 10,0000 prints | Initial stage | After 10,0000 prints | Initial stage | After 10,0000 prints |
| Inventive example 2-1 | A2 B1 | C2 | 700 | 695 | 25 | 35 | A | A | A | A | A | A |
| Inventive example 2-2 | A2 B5 | C2 | 700 | 695 | 35 | 45 | A | A | A | A | A | A |
| Inventive example 2-3 | A2 B1 | C3 | 700 | 695 | 40 | 65 | A | A | A | A | A | A |
| Inventive example 2-4 | A2 B5 | C3 | 700 | 695 | 45 | 70 | A | A | A | A | A | A |
| Inventive | A2 B1 | C4 | 700 | 695 | 40 | 65 | A | A | A | A | A | A |

TABLE 5-continued

| No. of inventive or comparative example | Intermediate layer composition | CGM | Quality evaluation (10° C., relative humidity 20%) | | | | | | | | | |
|---|---|---|---|---|---|---|---|---|---|---|---|---|
| | | | Electrical potential characteristic | | | | Image characteristic | | | | | |
| | | | $V_H$ (V) | | $V_L$ (V) | | Solid black uniformity | | Density deterioration of solid black area | | Occurrence of fog on the overall surface | |
| | | | Initial stage | After 10,0000 prints | Initial stage | After 10,0000 prints | Initial stage | After 10,0000 prints | Initial stage | After 10,0000 prints | Initial stage | After 10,0000 prints |
| Inventive example 2-5 | A2 B5 | C4 | 700 | 695 | 45 | 70 | A | A | A | A | A | A |
| Comparative example 2-6 | A2 B8 | C2 | 700 | 695 | 55 | 100 | B | C | A | A | A | B |
| Comparative example 2-1 | A2 B8 | C3 | 700 | 695 | 65 | 120 | B | C | A | A | A | B |
| Comparative example 2-2 | A2 B8 | C4 | 700 | 695 | 65 | 120 | B | C | A | A | A | B |
| Comparative example 2-3 | | | | | | | | | | | | |

TABLE 6

| No. of inventive or comparative example | Intermediate layer composition | CGM | Quality evaluation (33° C., relative humidity 80%) | | | | | | | | | |
|---|---|---|---|---|---|---|---|---|---|---|---|---|
| | | | Electrical potential characteristic | | | | Image characteristic | | | | | |
| | | | $V_H$ (V) | | $V_L$ (V) | | Solid black uniformity | | Density deterioration of solid black area | | Occurrence of fog on the overall surface | |
| | | | Initial stage | After 10,0000 prints | Initial stage | After 10,0000 prints | Initial stage | After 10,0000 prints | Initial stage | After 10,0000 prints | Initial stage | After 10,0000 prints |
| Inventive example 2-1 | A2 B1 | C2 | 700 | 695 | 25 | 35 | A | A | A | A | A | A |
| Inventive example 2-2 | A2 B3 | C2 | 700 | 695 | 30 | 40 | A | A | A | A | A | A |
| Inventive example 2-3 | A2 B1 | C3 | 700 | 695 | 35 | 60 | A | A | A | A | A | A |
| Inventive example 2-4 | A2 B3 | C3 | 700 | 695 | 40 | 70 | A | A | A | A | A | A |
| Inventive example 2-5 | A2 B1 | C4 | 700 | 695 | 35 | 60 | A | A | A | A | A | A |
| Inventive example 2-6 | A2 B3 | C4 | 700 | 695 | 40 | 70 | A | A | A | A | A | A |
| Comparative example 2-1 | A2 B8 | C2 | 700 | 695 | 50 | 140 | B | C | A | A | A | C |
| Comparative example 2-2 | A2 B8 | C3 | 700 | 695 | 60 | 160 | B | C | A | A | A | C |
| Comparative example 2-3 | A2 B8 | C4 | 700 | 695 | 60 | 160 | B | C | A | A | A | C |

These examples and comparative examples show the following.

An example is investigated here, in which images were formed and evaluated in the reversal development process, which is very sensitive to image defects, under the condition of low temperature and low humidity (temperature: 10° C., relative humidity: 20%). This example is shown on Tables 1 and 2.

In the case of an interlayer made of polyamide (CM8000), the values of V or VL was increased. Further, the occurrence of black spots were not sufficiently suppressed. (Comparative Example 1-33)

In a coating solution for the interlayer composed of a zirconium chelate compound (A10, A11) and silane coupling agent, precipitation was produced 3 days after the preparation of the coating solution. (Comparative Examples 1-3, 4, 10, 11, 17, 18, 24 and 25)

In the case of a metallic alkoxide compound (A9) having only alkoxy groups, image defects of black spots were caused (Comparative Example 1-2, 9, 16 and 23).

Even in the case of the metallic chelate compound, in the case where chelate groups except for β diketone and acetoacetic ester were provided (A12, A13 and A14), problems of image defects, electric potential characteristic or coating solution stability were caused. (Comparative Examples 1-5, 6, 7, 12, 13, 14, 19, 20, 21, 26, 27 and 28)

A metallic chelate compound (A8) containing no alkoxy group exhibited a relatively high performance with respect to the image characteristics, however, an increase of the residual electric potential was larger than that of the present invention. (Comparative Example 1-8, 15 and 22)

In the sample of a silane coupling agent, the end of the functional group Y is composed of a chlorine atom (B9) or a mercapto group (B10), cracks were caused. (Comparative Example 1-31 and 32)

In the sample having an epoxy group (B8) of a simple vinyl group (B7), image defects of black spots were remarkably caused. (Comparative Example 1-29 and 30).

On the other hand, the interlayer obtained from the metallic chelate compound and silane coupling agent of the present invention is provided with an excellent characteristic. In a photoreceptor having the interlayer of the present invention, problems of image defect and transfer memory were not caused, and even when the photoreceptor was repeatedly used, the residual electric potential was seldom increased. After a long period of time (60 days) had passed, a change in the coating solution was small. (Examples 1-27 and 28)

The inventors further analyzed the experimental data. It is preferable that the number of alkoxy groups of the metallic chelate compound is larger than the number of chelate groups. (In the compounds A3 containing a number of chelate groups, an increase of the residual electric potential is a little larger than that of others when the photoreceptor is repeatedly used.) (Examples 1-3, 10, 17 and 23)

The chelate group of acetoacetic ester and the chelate group of acetylacetone will be compared as follows. Three days after the preparation of the coating solution, both were the same. However, according to the potential characteristics (an increase of the residual electric potential in the case where the photoreceptor was repeatedly used), the chelate group of acetoacetic ester was superior to the chelate group of acetylacetone. (Examples 1-27 and 28)

Excellent performance of the interlayer of the present invention was exhibited even under the condition of high temperature and humidity (33° C., 80%), so that the occurrence of image defects was prevented, further the interlayer of the invention was effective for preventing the residual electric potential from rising. (Tables 3 and 4)

In the normal development process (Examples 2-1 to 2-6, Comparative Examples 2-1 to 2-3), the number of image defects of the photoreceptor having the interlayer of the present invention was smaller than that of Comparative Example, which shows the effectiveness of the present invention.

The imidazol-perylene compound or the TiOPc is excellent in the electrical carrier generating capacity, the characteristics of imidazol-perylene compound and TiOPc are sufficiently high.

The aforementioned photoreceptor containing imedazol-perylene compound or titanyl phthalocyanine has a high electric charge generation capacity. Therefore, even when the photoreceptor containing imedazol-perylene compound or titanyl phthalocyanine is assembled to a high speed copier, the linear velocity of which is high, or a semiconductor laser printer, a high contrast and resolution can be provided.

However, even when the above photoreceptor is used, the conventional problems caused on an image such as minute image defects of white spots (or black spots), transfer memory (belt-shaped fog caused in the process of transfer) or fog can not be solved especially when an interlayer made of resin is used.

The reason why the present invention can not overcome the problems of image defects will be described as follows while consideration is given to the basis of the principle of electrophotography:

According to the principle of electrophotography, the surface of an organic photoreceptor is electrically charged to be negative by means of corona discharge, and when the electrically charged surface is exposed to light, positive holes and electrons are generated, and the generated positive holes erase the negative charge on the surface, so that an electrostatic latent image is formed in accordance with an amount of irradiated light. Therefore, when positive holes are injected from the electrically conductive support except for the irradiation of light, the electrical potential on the negatively charged photoreceptor surface is lowered, which can be the cause of image defect and fog.

Especially in the case of a highly sensitive CGM such as positive holes made of imedazol-perylene compound or titanyl phthalocyanine, positive holes tend to be injected due to the defect or dirt of a conductive support. When the positive holes are injected, the formed image become defective. In the normal development, white spots are caused, and in the reversal development, black spots are caused. In the case of the reversal development, black spots appear on the white background, so that the image quality is greatly deteriorated. In order to solve the above problems, it is necessary to provide a uniform film on the interlayer for blocking the injection of positive holes.

Different from the above local image defects, the problem of belt-shaped fog (transfer memory) is caused, which is peculiar to the reversal development, wherein the belt-shaped fog is caused in a portion where a transfer sheet has not existed in the previous operation. The cause of belt-shaped fog is in the transfer process. In the transfer process, toner provided on an electrostatic latent image formed on the photoreceptor is transferred onto a transfer sheet. Commonly, in the transfer process, corona discharge is carried out on the reverse side of the transfer sheet. In this transfer process, a portion of the photoreceptor where the transfer sheet is not provided is subjected to corona discharge.

Usually, in the normal development process conducted in a copier, a transfer charge, the polarity of which is the same as that of the charging, is given, so that no problems are caused. However, in the reversal development, a negatively charged photoreceptor is used, and transfer is carried out by giving a positive charge, the polarity of which is reverse to that of the photoreceptor. Accordingly, when the photoreceptor surface is directly subjected to corona discharge, a negative charge is induced inside the photoreceptor by the action of the positive charge generated in the portion. In this case, the negative charge is accumulated at a position close to the interface between the charge generation layer and the interlayer. When this negative charge is not erased and the next charging operation (negative charge) is conducted on the photoreceptor surface, a sufficiently high charging potential can not be provided in the portion where a transfer sheet has not existed in the previous transfer. Accordingly, belt-shaped fog occurs on the image. In order to prevent the occurrence of belt-shaped fog, it is necessary to provide an interlayer that blocks positive holes, and it is also necessary to provide an interlayer that can quickly leak electrons. That is, in the photoreceptor for use with a laser printer in which reversal development is carried out using highly sensitive material such as titanyl phthalocyanine, it is necessary that the interlayer has an insulating property for the positive holes and also the interlayer has a conductive property for electrons. In other words, it is necessary that the interlayer has a property of N type semiconductor. It is difficult for an interlayer made of resin to have the aforementioned properties. Even when commonly used polyamide resin can not suppress the occurrence of transfer memory. Even the composition of ceramic interlayer can not provide a sufficiently high property. For example, according to Japanese Patent Publication Open to Public Inspection No. 247461/1992, a number of alkoxy metallic compounds are described. However, the above patent only lists the types of alkoxy metallic compounds, silane coupling agents and chelate groups. In order to severely suppress the occurrence of image defects, which is the object of the present inventors, it is necessary to more strictly select the materials to be used for the interlayer.

The present inventors made investigations into ceramic materials to be used for the interlayer so that the interlayer can be competently applied to a photoreceptor in which a highly sensitive CGM material such as titanyl phthalocyanine is used. The interlayer to be applied to a photoreceptor in which a highly sensitive CGM material is used is required to have a higher function for suppressing the occurrence of image defects. As a result of the investigation, the inventors found ceramic materials for the interlayer by which a rise of the residual potential is suppressed in the use of repetition and further the occurrence of fog caused by transfer memory is suppressed.

We claim:

1. An electrophotographic photoreceptor comprising (1) an interlayer and (2) a photosensitive layer provided in the listed order on a conductive support, wherein the photosensitive layer comprises a titanylphthalocyanine pigment and the interlayer comprises, in combination, a metallic chelate compound of formula I and a compound of formula II:

$$(RO)_mMX_n \qquad \text{I}$$

wherein R is an alkyl group; M is titanium or aluminum; X is a chelate forming group selected from a group consisting of an acetoacetic ester group and a β diketone group; and m and n are individually an integer more than I, wherein the sum of m and n is 4 when M is titanium and 3 when M is aluminum;

$$Z_aA_bSiY_c \qquad \text{II}$$

wherein Z is a hydrolysis group; A is an alkyl or aryl group; Y is an organic functional group having a methacryloxy or an amino group at the end thereof; and a and c are individually an integer not less than 1 and b is an integer not less than 0, wherein the sum of a, b and c is 4.

2. An electrophotographic photoreceptor of claim 1 wherein m is not less than n.

3. An electrophotographic photoreceptor of claim 1 wherein Z is an alkoxy group and c is 1 and a is 2 or 3.

4. An electrophotographic photoreceptor of claim 1 wherein the organic functional group represented by Y is —BOOC(R')C=$CH_2$, —BNHR" or —$BNH_2$, wherein B is an alkylene group or an alkylene group having —O—, —NH—, NR'— or CO— therein, R' is an alkyl or aryl group, and R" is an alkylene or arylene group.

5. An electrophotographic photoreceptor of claim 4 wherein the organic functional group represented by Y is —BOOC(R')C=$CH_2$ or —BNHR", wherein B is an alkylene group or an alkylene group having —O—, —NH—, NR'— or CO— therein, R' is an alkyl or aryl group, and R" is an alkylene or arylene group.

6. An electrophotographic photoreceptor of claim 4 wherein the organic functional group represented by Y is —BOOC(R')C=$CH_2$, wherein B is an alkyl group or an alkylene group having —O—, —NH—, NR'— or CO— therein, R' is an alkyl or aryl group.

7. An electrophotographic photoreceptor of claim 6 wherein R' is an alkyl having not more than 6 carbon atoms or an aryl group having not more than 8 carbon atoms.

8. An electrophotographic photoreceptor according to claim 1, wherein R is an alkyl group having not more than 4 carbon atoms.

9. An electrophotographic photoreceptor according to claim 1 wherein a hydrolysis group represented by Z is an alkoxy group, a halogen atom or an amine group.

10. An electrophotographic photoreceptor according to claim 1 wherein a hydrolysis group represented by Z is an alkoxy group having not more than 4 carbon atoms.

11. An electrophotographic photoreceptor according to claim 1, wherein M is a titanium.

12. An electrophotographic photoreceptor according to claim 1, wherein titanyl phthalocyanine of the pigment is a crystal form having peaks at 9.6°±0.2°, 11.7°±0.2°, 15.0°±0.2°, 24.1°±0.2° and 27.3°±0.2° in the X-ray diffraction spectrum with respect to Cu-Kα rays.

13. An image forming method comprising the steps of:

exposing a photoreceptor with light from a source having a primary energy peak between 600 and 850 nm and processing the exposed photoreceptor by reversal development; wherein the photoreceptor has, provided in the listed order on a conductive support, (1) an interlayer and (2) a photosensitive layer comprising a titanylphthalocyanine pigment, said interlayer comprising, in combination, a metallic chelate compound of formula I and a compound of formula II:

$$(RO)_mMX_n \qquad \text{I}$$

wherein R is an alkyl group; M is titanium or aluminum; X is a chelate forming group selected from a group consisting of an acetoacetic ester group and a β diketone group; and m and n are individually an integer more than 1, wherein the sum of m and n is 4 when M is titanium and 3 when M is aluminum;

$$Z_aA_bSiY_c \qquad \text{II}$$

wherein Z is a hydrolysis group; A is an alkyl or aryl group; Y is an organic functional group having a methacryloxy or an amino group at the end thereof; and a and c are individually an integer not less than 1 and b is an integer not less than 0, wherein the sum of a, b and c is 4.

14. The electrophotographic photoreceptor of claim 1 wherein the crystal form of the titanylphthalocyanine pigment is Y-type.

* * * * *